US005694877A

United States Patent [19]

Hvide

[11] Patent Number: 5,694,877

[45] Date of Patent: Dec. 9, 1997

[54] SHIP DOCKING VESSEL

[75] Inventor: Johan Erik Hvide, Gulfstream, Fla.

[73] Assignee: Hvide Marine Incorporated, Ft. Lauderdale, Fla.

[21] Appl. No.: 670,784

[22] Filed: Jun. 24, 1996

[51] Int. Cl.[6] ..... B63B 1/00

[52] U.S. Cl. ..... 114/56; 114/63; 114/242

[58] Field of Search ..... 114/56, 63, 242, 114/57, 123

[56] References Cited

U.S. PATENT DOCUMENTS

| | | | |
|---|---|---|---|
| 102,111 | 4/1870 | Gird | 114/63 |
| 203,940 | 5/1878 | Rees . | |
| 2,347,077 | 4/1944 | Burgess . | |
| 2,347,785 | 5/1944 | Lovell . | |
| 3,176,645 | 4/1965 | Shatto, Jr. . | |
| 3,536,025 | 10/1970 | Tierney . | |
| 3,750,607 | 8/1973 | Seymour et al. | 114/242 |
| 3,895,593 | 7/1975 | Moore . | |
| 4,046,096 | 9/1977 | Liaaen . | |
| 4,369,725 | 1/1983 | Lord et al. . | |
| 4,493,660 | 1/1985 | Becker et al. . | |
| 4,580,517 | 4/1986 | Lundberg . | |
| 4,928,613 | 5/1990 | Rudolf . | |
| 4,998,898 | 3/1991 | Dufrene . | |
| 5,488,918 | 2/1996 | Johnson, Jr. et al. . | |

FOREIGN PATENT DOCUMENTS

| | | | |
|---|---|---|---|
| 31874 | 3/1965 | Germany | 114/242 |

OTHER PUBLICATIONS

Fig. 11 of Omni 2000 a True Omni–Directional Ship Assist Tug from paper given at 1994 Interantional Tug and Salvage Confernece; author Rob Allan of Vancouver, B.C.

*Primary Examiner*—Jesus D. Sotelo
*Attorney, Agent, or Firm*—Banner & Witcoff, Ltd.

[57] ABSTRACT

An improved ship docking vessel is provided that has a substantially flat, elliptical bottom having a large beam-to-length ratio to provide a shallow draft. In addition, the vessel of the present invention is provided with two Z-drives disposed diagonally opposite the longitudinal axis of the bottom. Each of the drives is adapted to rotate 360° about its central shaft. Because there is no keel, the vessel is provided with a pair of skegs disposed fore and aft along the center line of the longitudinal axis of the substantially flat bottom. The skegs are disposed outside the Z-drives and provide for enhanced maneuverability and increased directional stability of the vessel. In a preferred embodiment, the flat bottom has curved ends and parallel sides, and the entire flat bottom is longitudinally and transversely symmetrical. The hull includes a substantially uniform flare between the flat bottom and the flat bumper portion to facilitate movement of the vessel in any direction and to improve vessel stability. The skegs extend below the drives to protect them from bottoming out and to act as support for the hull when the vessel is dry-docked. In an alternative embodiment, a cycloidal drive system may be used instead of the Z-drive system.

21 Claims, 4 Drawing Sheets

SHIP DOCKING VESSEL

FIELD OF THE INVENTION

The present invention relates to ship docking vessels, such as, for example, tug boats and the like. In particular, the invention is directed to a ship docking vessel having an improved hull design and propulsion system that provides increased maneuverability and stability, thereby facilitating application of full pushing or tugging force in any direction.

BACKGROUND OF THE INVENTION

Conventional tugboats have been designed with large-diameter, fixed-directional propellers for providing the desired levels of thrust. This approach has resulted in relatively deep drafts for harbor tugboats, often preventing their use in shallow inland waters. The fixed direction of thrust limited the tugboat to handling vessels only by pushing or pulling them parallel to the centerline of the tugboat's hull. Accordingly, not only could the tugboats not apply thrust in any direction, other than fore or aft, but they also lacked the necessary transverse stability to resist heeling, with a significant danger of capsizing if subjected to any transverse force. In ship handling and docking of large vessels, tugboats are typically tied alongside either parallel to or at fight angles to the vessel's centerline (this is the normal method in most U.S. ports), a rapid change in the application of tugboat thrust normal to the vessel's centerline cannot be achieved without completely reorienting the tugboat. This also imparts excessively high torque to the rudder. Such an operation also requires handling of lines by the boat's crew, and involves considerable time. In some instances, such an operation may become impossible because of insufficient space between the ship and the dock, or because of other vessels or restrictions in the vicinity. Extreme care must be exercised to ensure that the tugboat is not subjected to transverse loads by its own actions or by loads imposed by the vessel being assisted, through the towing hawser which could tip and capsize the tugboat.

Designs of tugboats have traditionally incorporated ship-shape forms for tug hulls, with bow and stem lines and having compound curvature with shell plating. Such forms necessitate high construction costs, whereas simple straight-framed sections with fully developable shell plating are much less expensive. In any event, numerous shipyards were developed specifically for efficiently constructing such high-cost traditional tugboats.

Another problem with conventional tugboats is that their general hull configuration provides relatively small and confining deck areas, thus restricting optimal location of towing winches and mooring devices, as well as efficient action of the crew in handling lines both fore and aft of the boat.

In addition to the fact that propeller thrust of prior art tugboats was unidirectional, the hull configuration of such tugboats was asymmetrical from bow to stern. Such a configuration imposed a unidirectional thrusting feature. Therefore, prior art tugboats have been greatly handicapped by being unable to achieve optimum performance in most operations without releasing and changing hawsers, lines, etc. to reorient the tugboat so that it could push in the desired direction and position.

While prior art tugboats traditionally have been considered to have good maneuverability, particularly when large rudders, flanking rudders, nozzles, etc. have been installed, the designs have typically been limited by the need to use multiple towing hawsers to maintain the desired orientation and position with respect to the vessel being assisted and by the inherent limitations on its effectiveness due to the limited transverse stability of the tugboat.

Moreover, tugboats have had increasing power levels of parallel propulsion machinery installed, partly to meet demands for high thrust levels in handling ships and barges, and partly to hold the tug in the proper position using opposing thrust and rudder action. While these problems have been undesirable, they have not been solved by resorting to a brute-force approach.

Some tugboat designers have implemented the use of single or plural omni-directional drives to improve the application of thrust in directions other than parallel to the centerline of the tug. While using these omni-directional drives provided certain directional advantages, problems are still encountered when the tug is tied to another vessel. Transverse stability becomes even more critical to the safety of the tug because it is now able to impose significant transverse forces on itself through the direction of propulsion thrust in a direction other than parallel to the centerline of the tug.

Tugboats in the past have had many problems with capsizing and foundering due to their low levels of freeboard, low reserve buoyancy, and inadequate stability. Poor resistance to heeling and deck-edge submergence under operating conditions has often resulted in conventional tugboats "tripping" or being "in irons," causing them to capsize and sink.

SUMMARY OF THE INVENTION

The present invention provides an improved ship docking tug that overcomes deficiencies in known tugboat systems. In particular, the present invention provides a ship docking vessel wherein the hull and propulsion system designs are combined to provide improved maneuverability while facilitating the application of full force in any direction.

Accordingly, it is an object of the invention to provide an improved ship-docking module that can run efficiently in any direction, i.e., forward, aft, port, or starboard.

It is another object of the present invention to provide a ship-docking vessel that can apply full thrusting force in any direction. This can be by any one of pushing, towing, or "hipped-up" to another vessel.

Another object of the present invention is to keep the ship-docking vessel stable, minimize list and trim, and reduce or eliminate a situation that would result in deck edge submergence. This may be accomplished by having a flare on all sides that increases the displacement and water plane as the vessel is listed or trimmed by the application of force resulting from the ship being maneuvered by the vessel.

Yet another object of the invention is to provide a ship-docking vessel having minimized draft to enable easy maneuverability and more versatile operation.

A further object of the present invention is to provide a ship-docking vessel having minimal need for the use of lines or hawsers, thereby speeding up the docking/undocking procedure and reducing the manpower required to handle the lines. This feature also has the added benefit of reducing the risk of personal injury while handling the lines.

Still another object of the present invention is to provide a large, open clear deck area, wherein winches, staples, and chocks can be arranged for efficiency of handling in a variety of configurations, depending upon the operator's needs, thereby providing a safer working platform.

A further feature of the present invention is the arrangement of a pair of skegs, fore and aft, that provide directional stability in any direction, while eliminating the need for a keel. Additionally, the skegs may provide support for the hull when the vessel is dry-docked.

These and other objects, and their attended advantages, are achieved by the present invention, which provides an improved ship-docking vessel comprising: a hull having a substantially flat bottom, said flat bottom being substantially elliptical and longitudinally and transversely symmetrical; a pair of omni-directional thrusters supported by said flat bottom and being disposed diagonally opposite one another with respect to a longitudinal axis of the bottom; and a pair of skegs extending below the flat bottom and being disposed outside each of the thrusters and along a center line of the longitudinal axis of the flat bottom, wherein the skegs extend downwardly below the thrusters.

BRIEF DESCRIPTION OF THE DRAWINGS

The invention will be described in detail herein with reference to the following drawings, in which like reference numerals refer to like elements throughout the several views, and wherein.

DETAILED DESCRIPTION OF THE PREFERRED EMBODIMENTS

Figure 1:
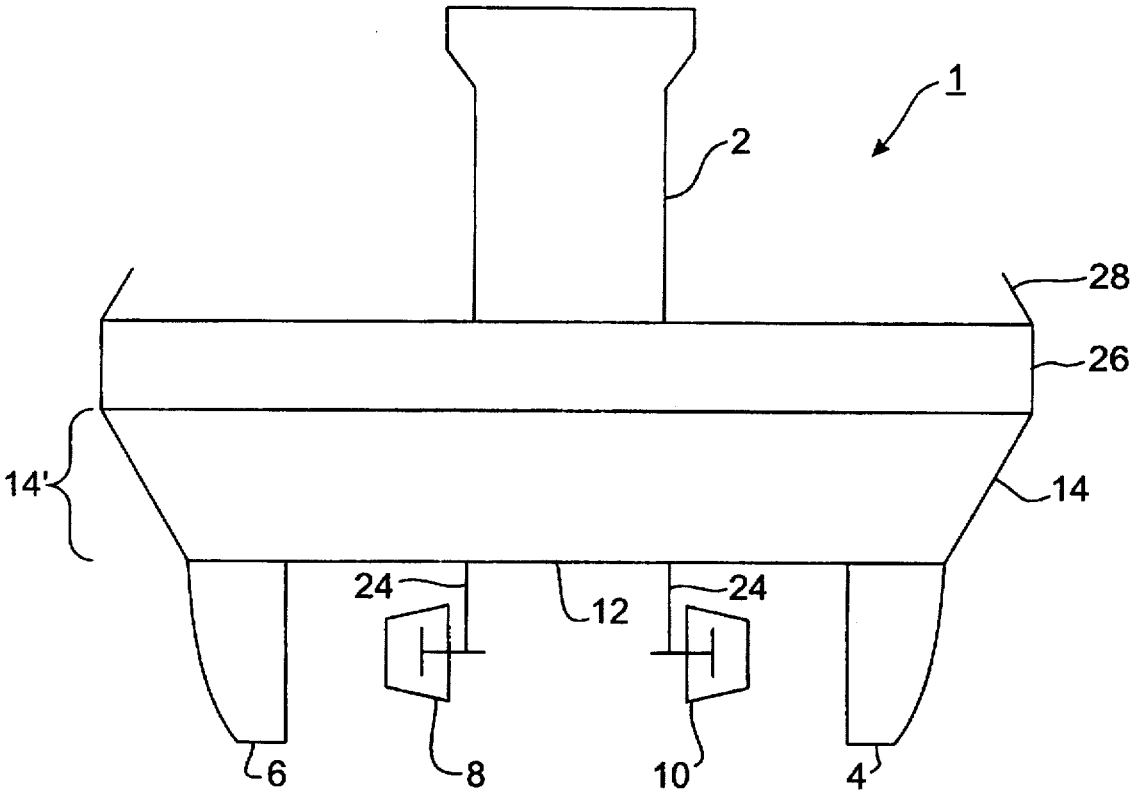
FIG. 1 is a side view of the ship-docking vessel of the present invention.
Figure 2:
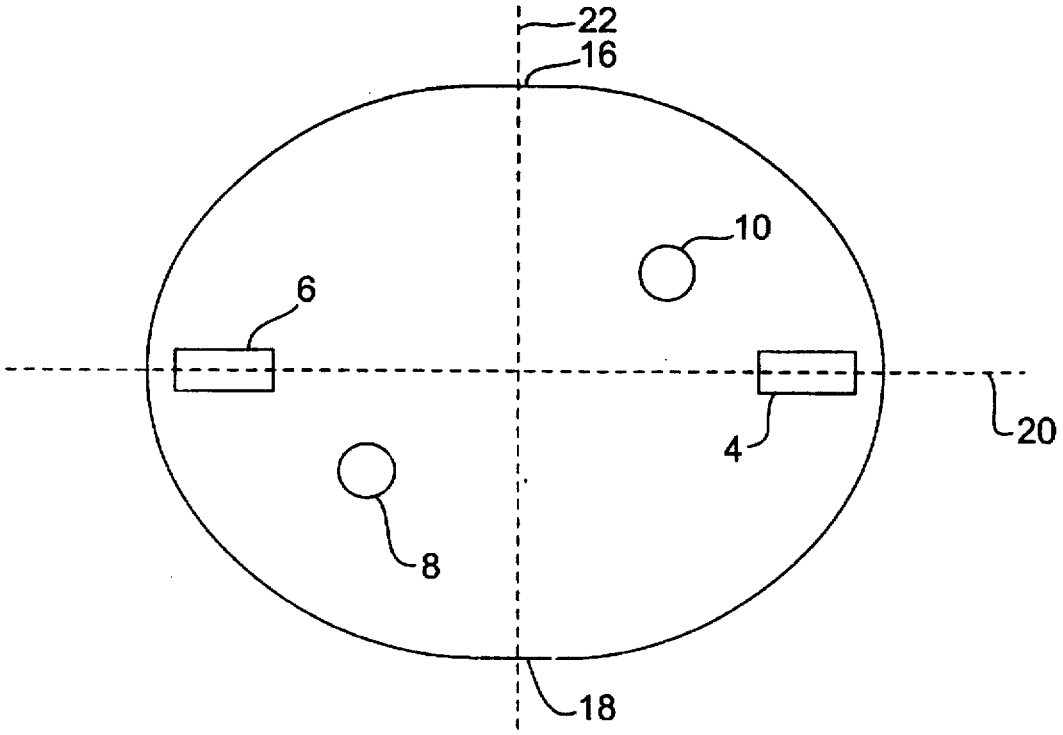
FIG. 2 is a view of the flat bottom of the ship-docking vessel of the present invention.

FIG. 1 shows a side view of the ship-docking vessel 1 according to the preferred embodiment of the present invention. Ship-docking vessel 1 optionally includes a control tower 2 from which an operator may control operations of the vessel. The control tower 2 is preferably of a height that facilitates a clear view of the operational area and provides a 360° view. The hull 14 has a uniform flare 14', preferably having an angle of 20° and 70° with respect to the bottom on all sides, and includes a substantially flat bottom 12. In a preferred embodiment of the invention, the bottom 12 is joined directly to the hull 14 to minimize the use of compound curved plates and shaped members of construction. The flat bottom 12 is preferably substantially elliptical in shape, as shown in FIG. 2, with transversely opposed sections 16, 18, that are parallel with respect to the longitudinal axis 20 of the flat bottom 12. The parallel sections 16, 18 facilitate the application of force to a vessel being docked (not shown), especially when the ship-docking vessel 1 is "hipped up" to the vessel being docked. The hull 14 also includes a bumper area 26 that is used to engage a vessel being docked, and through which force is applied to the vessel being docked to maneuver it into position. Additionally, the hull 14 may include guards 28 that provide additional protection against weather and water overflow.

The flat bottom 12 also supports a pair of skegs 4, 6 that extend downwardly therefrom. Because the bottom 12 is substantially flat, there is no keel. Accordingly, the skegs 4, 6 provide the requisite maneuverability to the vessel 1. Additionally, the use of skegs facilitates fast response for turning or stopping the vessel 1 that was heretofore not present in conventional tugboat designs. The skegs 4, 6 are preferably disposed fore and aft along the center line of the longitudinal axis 20 at the bottom 12. Skegs 4, 6 preferably extend downwardly a distance sufficient to clear the thrusters 8, 10. By extending the skegs this amount, the skegs not only provide improved handling and maneuverability, but they also serve to protect and maintain the thrusters 8, 10, especially when the vessel is dry-docked.

The ship-docking vessel 1 is also provided with a pair of omni-directional thrusters 8, 10 that also extend below the flat bottom 12 of the vessel 1. The omni-directional thrusters 8, 10 rotate about a shaft 24 extending downwardly from the flat bottom 12. The thrusters 8, 10 are referred to in the art as "Z-drives," and the operational and mechanical details thereof are well known to those skilled in the art. Z-drives provide improved maneuverability when coupled with the hull and skeg design of the instant invention, and facilitate the application of full-thrust in any direction. The preferred embodiment, the thrusters 8, 10, are disposed diagonally opposite the center line of the longitudinal axis 20 of the flat bottom 12, as shown in FIG. 2, and are clear of the hull. This arrangement further facilitates the maneuverability and efficiency of the vessel 1.

Figure 3:
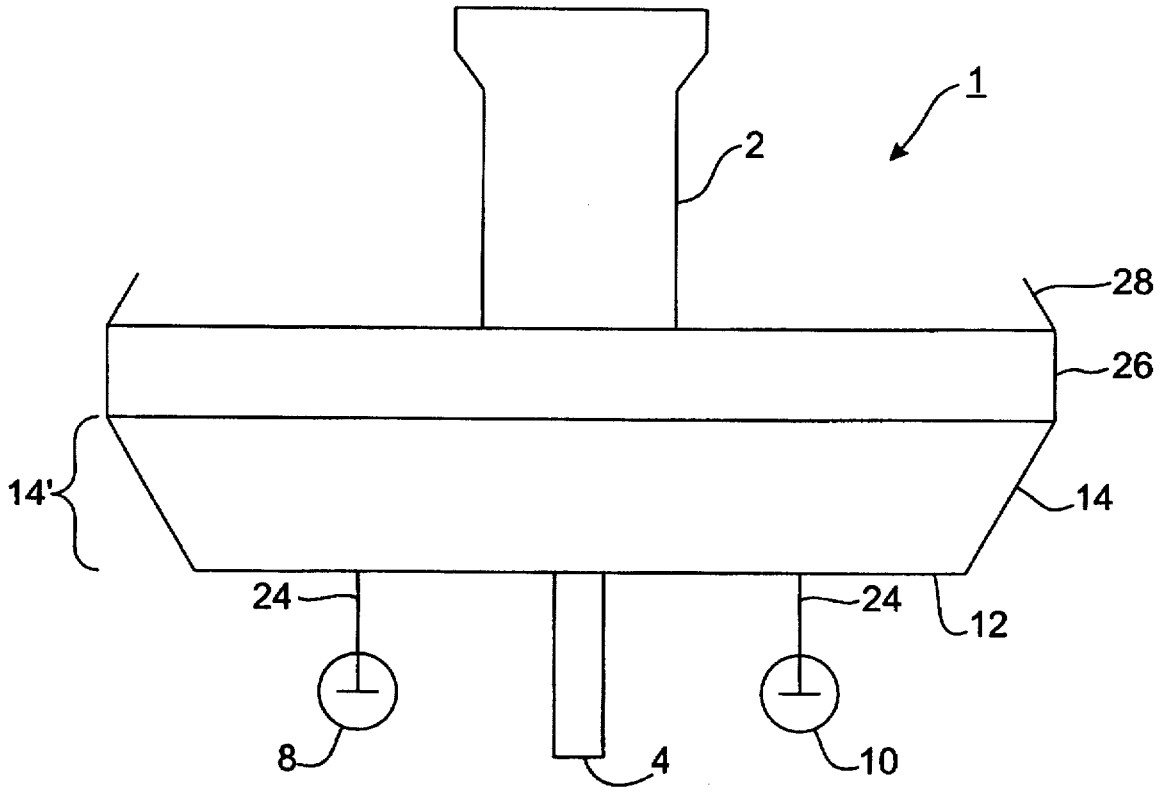
FIG. 3 is a rear view of the ship-docking vessel of the present invention.
Figure 4:
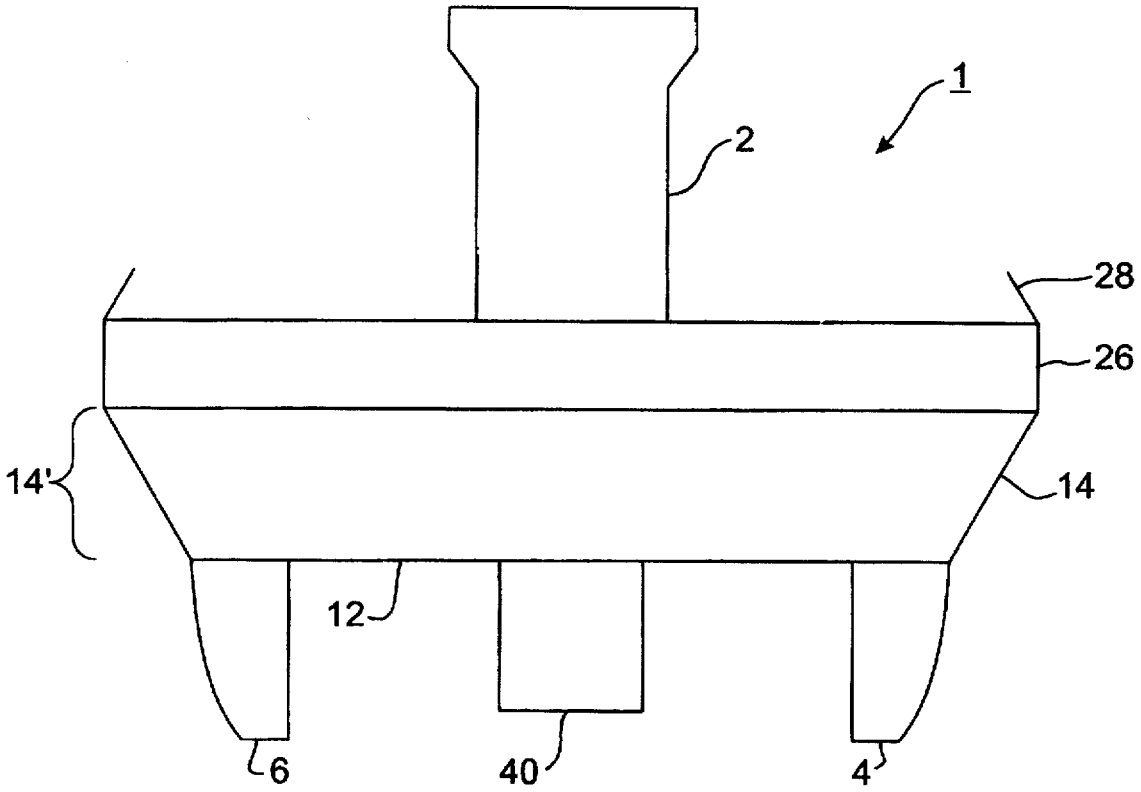
FIGS. 4–6 are views of an alternative embodiment of the invention corresponding to FIGS. 1–3, but having a single cycloidal drive system.
Figure 5:
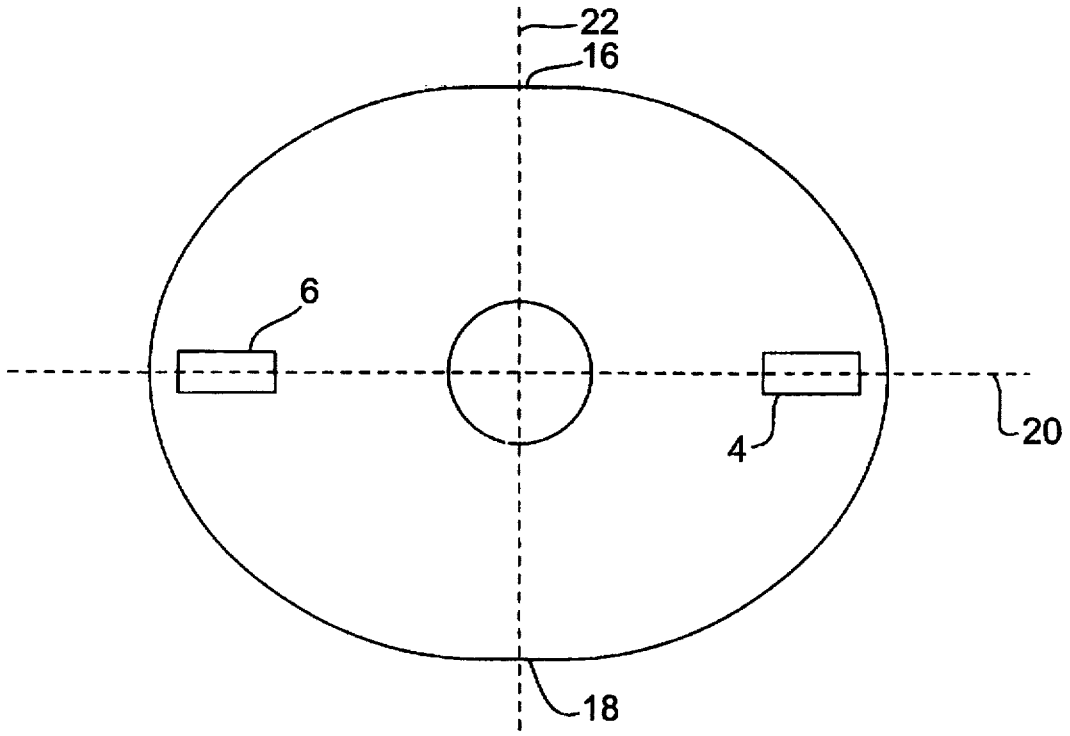
Figure 6:
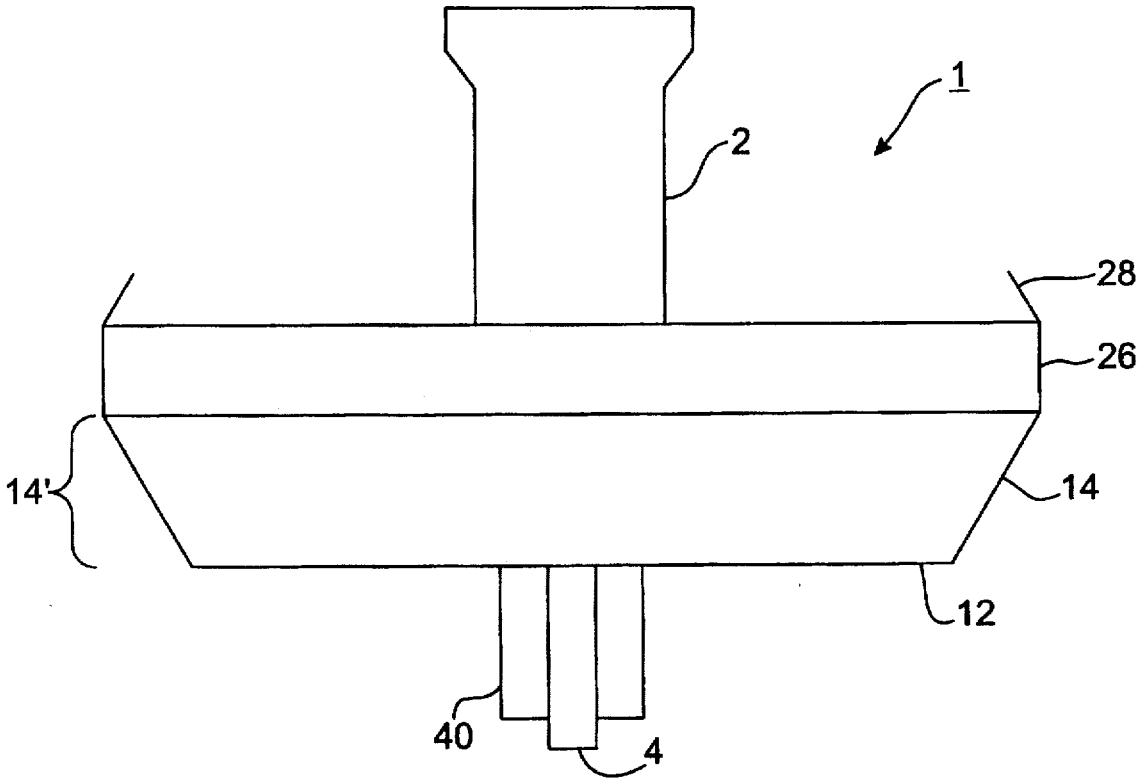

The ship docking vessel 1 also may be optionally equipped with one or more cycloidal propulsion units 40, known in the art as a Voith-Schneider design, in lieu of the aforementioned Z-drives. This embodiment is illustrated in FIGS. 4–6. It will be understood that the features and advantages of the embodiment shown in FIGS. 1–3 will, likewise, be realized in the alternate embodiment of FIGS. 4–6.

Additionally, the flat bottom 12 of the vessel 1 of the present invention has a high beam-to-length ratio. The high ratio of beam to length decreases the draft of the hull 14 to as little as 3'6". This low draft facilitates maneuverability and operational capability, especially in shallow and confined areas. Moreover, due to the shallow hull of the vessel 1, the Z-drives 8, 10 are clear of any obstruction of the flow of water, thereby providing maximum thrust even when the vessel 1 is alongside another hull. This arrangement further provides faster response, improved stability, and improved maneuverability when the vessel 1 is running alone.

The shape of the flat bottom 12 is symmetrical about the transverse and longitudinal axes 22, 20, having symmetrical curved ends fore and aft. The transverse opposite sides 16, 18 preferably have a parallel flat section, but, otherwise, the flat bottom 12 has a substantially elliptical shape. The curved hull shape and rounded ends facilitate maneuverability and the application of full force by the vessel in any direction. Additionally, the curved hull provides enhanced maneuverability about the front and angled portions of a vessel being towed to improve the guiding capability of the ship-docking vessel 1.

In operation, the vessel 1 of the present invention provides many operational and design advantages over conventional ship-docking vessel designs. The hull of the vessel 1 is symmetrical, as described above, and has a preferably parallel midsection 16, 18. This hull configuration, coupled with the Z-drive and skeg arrangement of the instant invention, provides directional stability and maneuverability to the vessel.

In addition, the bottom 12 of the vessel 1 is substantially flat and has a high beam-to-length ratio. A flat bottom having a high beam-to-length ratio reduces draft and improves speed in all directions, thereby improving performance. It has been found that a beam-to-length ratio of greater than 70% is preferred. The bottom 12 is joined directly to the hull, further simplifying construction by eliminating the need for bilge chines and reducing the need for curved plates. The high beam-to-length ratio also provides increased stability and reduces the amount of list and trim experienced when moving another vessel.

The large flat-bottom, open-hull design also facilitates easy arrangement of equipment on the relatively large clear deck space. For example, winches, staples, chocks, and the like may be arranged in various configurations according to the requirements of the operator for efficient ship handling. The arrangement of the skegs 4, 6 and thrusters 8, 10, as described above, provides numerous operational advantages. Z-drives are adapted to extend below the hull, as with conventional Z-drives, but, due to the shallow hull configuration of the instant invention, these drives are clear of any obstructions of the flow of water. This arrangement provides maximum thrust, even when the ship-docking vessel 1 is alongside another hull, and provides quick response when the vessel 1 is running alone. Furthermore, by being arranged diagonally opposite longitudinal axis 20 of the bottom 12, the drives 8, 10 provide quick response, fast stopping, turning, and directional stability in any direction. Additionally, the arrangement allows the operator to apply full force in any direction, i.e., pushing, pulling, or "hipped-up" to another vessel. Moreover, the vessel 1 is equally well suited for movement in any direction, i.e., fore, aft, port, or starboard when running alone or in applying steering force to an assisted vessel.

While this invention has been described in conjunction with specific embodiments thereof, it is evident that many alternatives, modifications, and variations will be apparent to those skilled in the art. Accordingly, the preferred embodiments of the invention, as set forth herein, are intended to be illustrative, not limiting. Various changes may be made without departing from the true spirit and full scope of the invention as defined by the following claims.

What is claimed is:

1. A ship docking vessel, comprising:

a hull having a substantially flat bottom, said flat bottom being substantially elliptical and longitudinally and transversely symmetrical;

first and second omni-directional thrusters extending below said flat bottom, said first and second thrusters being disposed diagonally opposite each other with respect to a longitudinal axis of the bottom; and first and second skegs extending below said flat bottom and being disposed fore and aft of said first and second thrusters along a centerline of the longitudinal axis of the bottom, respectively, wherein said skegs are separate from said first and second thrusters and extend below the first and second thrusters.

2. The ship docking vessel of claim 1, wherein said flat bottom has a beam to length ratio greater than 70%.

3. The ship docking vessel of claim 1, wherein said hull further comprises a bumper portion, said bumper portion being used to apply a force to a vessel being maneuvered by said ship docking vessel.

4. The ship docking vessel of claim 1, wherein said flat bottom includes transversely opposite sections that are parallel with respect to the longitudinal axis of the flat bottom.

5. The ship docking vessel of claim 1, further comprising a uniform flare extending upward from said bottom and having an angle in the range of 20° to 70° with respect to said bottom.

6. The ship docking vessel of claim 5, wherein the angle of the flare is approximately 45°.

7. A tugboat, comprising:

a hull having a substantially flat bottom joined directly to said hull, said flat bottom being substantially elliptical and longitudinally and transversely symmetrical;

a pair of omni-directional thrusters supported by said flat bottom and being disposed diagonally opposite one another with respect to a longitudinal axis of the bottom; and a pair of skegs extending below said flat bottom, each of said skegs being separate from said thrusters and being disposed outside each of said thrusters along a centerline of the longitudinal axis of the flat bottom, said skegs extending downwardly below said thrusters.

8. The tugboat of claim 7, wherein said flat bottom includes transversely opposed sections that are parallel with respect to the longitudinal axis of the bottom.

9. The tugboat of claim 8, having a beam-to-length ratio of greater than 70%.

10. The tugboat of claim 9, wherein said thrusters are Z-drives.

11. The tugboat of claim 7, wherein longitudinally opposite ends of the flat bottom have the same radius of curvature.

12. The tugboat of claim 7, wherein said hull further comprises a bumper, said bumper being used to apply a force to a vessel being maneuvered by said tugboat.

13. The tugboat of claim 7, further comprising a uniform flare extending upward from said bottom and having an angle in the range of 20° to 70° with respect to said bottom.

14. The tugboat of claim 13, wherein the angle of the flare is approximately 45°.

15. A tugboat, comprising:

a hull having a substantially flat bottom, said flat bottom being substantially elliptical and longitudinally and transversely symmetrical;

at least one omni-directional thruster extending below said flat bottom; and first and second skegs extending below said flat bottom and being disposed fore and aft of said at least one thruster along a centerline of the longitudinal axis of the bottom, respectively, said skegs being separate from said at least one thruster and extending below said at least one thruster.

16. The tugboat of claim 15, wherein said at least one thruster is a cycloidal thruster.

17. The tugboat of claim 16, wherein said at least one thruster is disposed at approximately a center portion of the flat bottom.

18. The tugboat of claim 17, wherein said flat bottom has a beam to length ratio greater than 70%.

19. The tugboat of claim 15, further comprising a uniform flare extending upward from said bottom and having an angle in the range of 20° to 70° with respect to said bottom.

20. The tugboat of claim 19, wherein the angle of the flare is approximately 45°.

21. The tugboat of claim 15, wherein said hull further comprises a bumper portion disposed adjacent to a flare, said bumper portion being used to apply a force to a vessel being maneuvered by said ship docking vessel.

* * * * *